US006314698B1

(12) United States Patent
Johansson

(10) Patent No.: US 6,314,698 B1
(45) Date of Patent: Nov. 13, 2001

(54) CLADDING PANELS OF SHEET METAL OR SIMILAR MATERIAL FOR FORMING A COFFERED CEILING AND A METHOD FOR ASSEMBLING OF SUCH PANELS

(75) Inventor: Anders Johansson, Overkalix (SE)

(73) Assignee: Isolamin AB, Overkalix (SE)

( * ) Notice: Subject to any disclaimer, the term of this patent is extended or adjusted under 35 U.S.C. 154(b) by 0 days.

(21) Appl. No.: 09/555,495

(22) PCT Filed: Jun. 26, 1998

(86) PCT No.: PCT/SE98/01259

§ 371 Date: Aug. 11, 2000

§ 102(e) Date: Aug. 11, 2000

(87) PCT Pub. No.: WO99/28569

PCT Pub. Date: Jun. 10, 1999

(30) Foreign Application Priority Data

Dec. 1, 1997 (SE) ..... 9704459

(51) Int. Cl.[7] ..... E04D 1/00

(52) U.S. Cl. ..... 52/478; 52/588.1; 52/519; 52/535; 52/542

(58) Field of Search ..... 52/478, 520, 588.1, 52/580, 519, 578, 534, 535, 542, 537

(56) References Cited

U.S. PATENT DOCUMENTS

| | | | |
|---|---|---|---|
| 4,091,588 | 5/1978 | Heirich | 52/478 |
| 4,295,316 | 10/1981 | Carlson | 52/588 |
| 4,736,564 | 4/1988 | Gailey | 52/484 |
| 5,651,221 * | 7/1997 | Golen | 52/202 |
| 5,673,524 * | 10/1997 | Gailey et al. | 52/309.9 |

FOREIGN PATENT DOCUMENTS

| | | |
|---|---|---|
| 343614 | 2/1960 | (CH) . |
| 4403403 | 8/1985 | (DE) . |
| 2307924 | 6/1997 | (GB) . |

* cited by examiner

*Primary Examiner*—Carl D. Friedman
*Assistant Examiner*—N. Slack
(74) *Attorney, Agent, or Firm*—Burns, Doane, Swecker & Mathis, L.L.P.

(57) ABSTRACT

Panels for coffered ceilings comprising cladding panels of sheet metal or similar material and a method for mounting such panels. Each cladding panel comprises an essentially flat principal surface enclosed by longitudinally running joining sections as well as at least one longitudinally running stiffening section bent at an angle to the principal surface. The joining sections are designed so that any chosen panel can be removed simply and without the use of tools, so that a good seal is obtained between the panels, and so that it is possible to draw apart these to fit certain dimensions. In addition, the panels should hook into each other and remain sealed even if they should expand and buckle downwards due to fire or some other reason. According to the invention, this is solved by each of the joining sections of the panels being designed with a spacer section that ends in a hook-shaped section and that the spacer sections and the hook-shaped sections are designed so that they allow tightening and a certain displacement between the joining sections of close-by panels that overlap, and that the hook-shaped sections hook into each other first when the panels have been dawn apart a short distance from each other.

1 Claim, 2 Drawing Sheets

CLADDING PANELS OF SHEET METAL OR SIMILAR MATERIAL FOR FORMING A COFFERED CEILING AND A METHOD FOR ASSEMBLING OF SUCH PANELS

FIELD OF THE INVENTION

The present invention concerns panels for coffered ceilings consisting of cladding panels of sheet metal or similar material and a method for mounting such panels. More specifically, the present invention relates to coffered ceilings comprising cladding panels, each cladding panel comprises an elongated element with a constant cross-sectional profile and is mainly composed of an essentially flat principal surface enclosed by longitudinally running joining sections as well as at least one longitudinally running stiffening section bent at an angle to the principal surface.

BACKGROUND OF THE INVENTION

Profiles for coffered ceilings with longitudinal joining sections and with parts that interact for joining together are known from GB 2 307 924. U.S. Pat. No. 4,295,315 and U.S. Pat. No. 4,091,588 refer to construction panels designed for mounting by means of attachment elements that are hidden when the following profile is hooked or snapped over the attachment element of the preceding profile. In CH 343 614, the joining sections consist of a U-shaped part and a flange that is positioned in the U-shaped part of the preceding element.

None of the previously known documents show or indicate anything about profiles that while sealed allow displacement between one another and that first hook into each other once they have been drawn apart. Of the panels referred to above, only the construction panels are intended to be mounted in place without attachment elements.

SUMMARY OF THE INVENTION

One problem that is solved by the invention is that of designing the sections for joining together so that any chosen panel can simply and without the use of tools, be removed to allow access for electrical and other installations above the panels that form the coffered ceiling.

Another problem that is solved by the present invention is that of achieving a good seal between panels, yet that still allows the possibility of them being able to be drawn apart so that they can be adjusted to fit certain dimensions. The joints between the panels are designed so that they do not allow flames and hot gasses to pass though and so that the panels display good acoustic properties. In addition, the panels are designed so that they can be mounted in place without the use of any tools or attachment devices by them being positioned on and resting against the edges of beams, girders or other framing sections.

The profiles of the panels according to the present invention are specially designed to hook into each other and remain tight even if expansion due to fire or some other reason should cause them to buckle downwards.

These and other problems are solved according to the invention, in the first hand by joining sections of close-by or adjacent sections when mounted in place normally overlapping and being provided with hook-shaped folds that hook into one another only if the panels are pulled apart a short distance or if they should buckle downwards.

BRIEF DESCRIPTION OF THE DRAWINGS

The invention will be described in more detail with the help of an example of an embodiment with reference to the attached drawings, where.

DETAILED DESCRIPTION OF THE INVENTION

Figure 1:
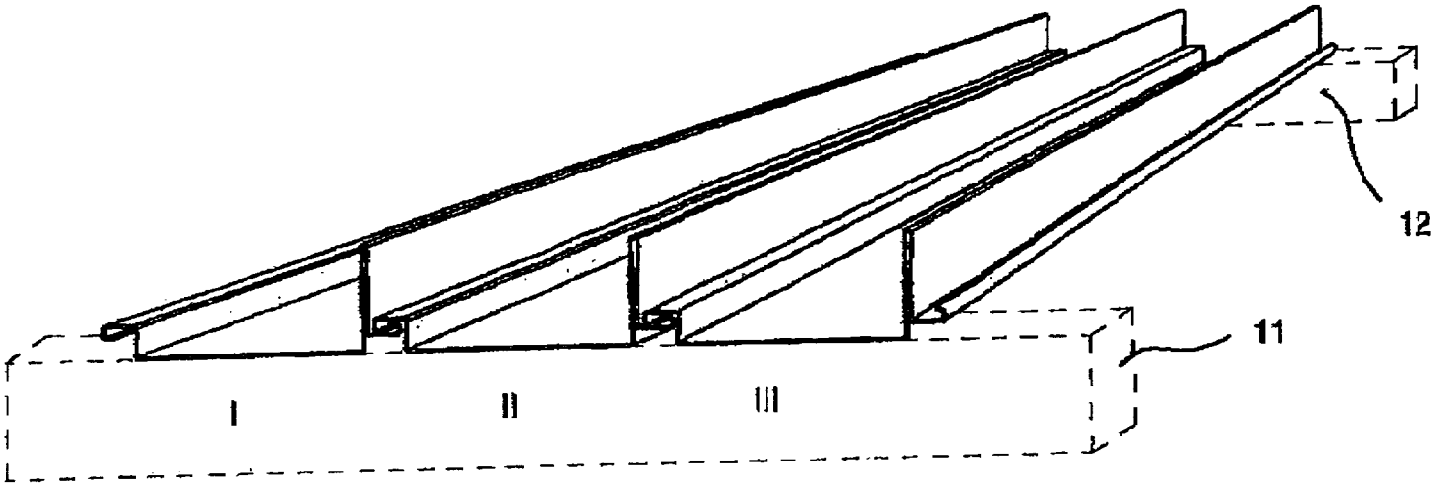
FIG. 1 shows a perspective view of one embodiment of the invention with three panels following each other.
Figure 2:
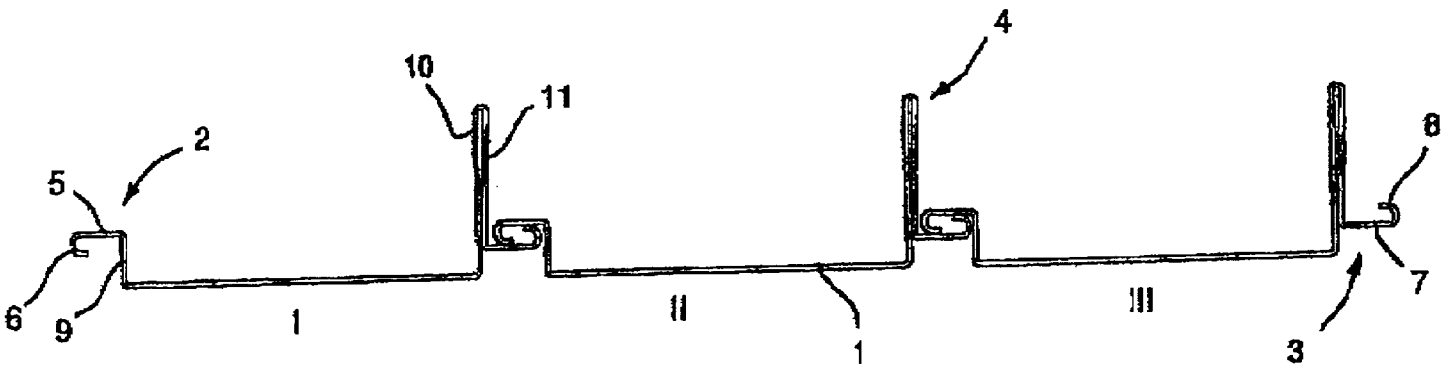
FIG. 2 shows a cross-section of panels according to FIG. 1.

According to one embodiment of the invention, the three identical panels, I, II, and III in FIG. 1 and FIG. 2, are positioned as they are normally mounted, i.e. lying on beams 11 and 12. Each panel comprises an elongated element with a constant crosssectional profile and is manufactured in bent sheet material or other material that can be suitably given the desired profile. The panel is built up of a flat principal surface 1 enclosed by at least one longitudinally running joining sections 2, 3 plus at least one longitudinally running stiffening section 4 bent at an angle to the principal surface 1.

The joining sections 2, 3 are arranged so that each one of them interacts with the opposite section on an adjacent panel and forms a tight joint when the left-hand joining section 2 seen in the figure is placed so that it overlaps the right-hand section 3. To achieve this objective, the left-hand section is designed with a flat spacer section 5 that ends in a downwardly curved, hook-shaped section 6, while the right-hand section 3 is designed with an equivalent spacer section 7 that ends in an upwardly curved, hook-shaped section 8. The flat spacer sections 5, 7 are parallel with the principle surface 1 and are arranged on different elevations in relation to the principle surface 1 so that the end part of the hooked-shaped section 6 lies close to the flat spacer section 7 and the end part of the hooked-shaped section 8 lies close to the flat spacer section 5 of the adjacently positioned panel when they are mounted in position. These different elevations are achieved via an angled section 9 at the left-hand joining section and a second angled section coincident with the stiffening section 4 and that consists of a U-shaped bent flange with different lengths of shank sections 10 and 11 respectively.

Figure 3:
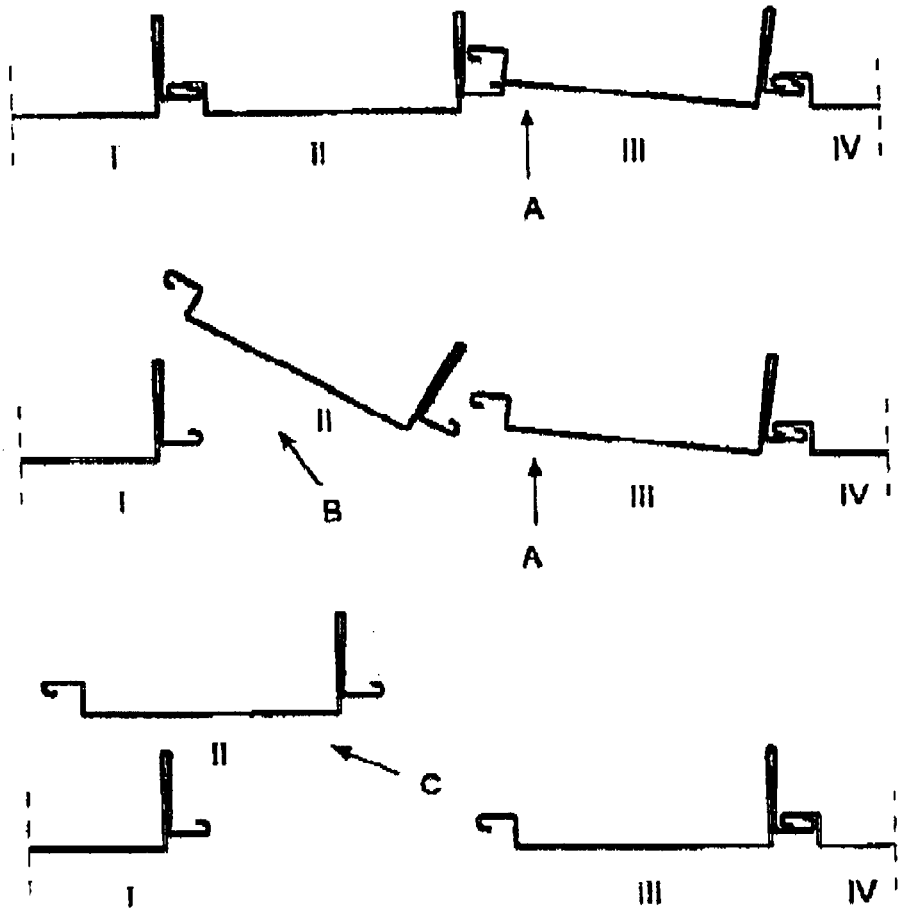
FIG. 3 shows the removal of a panel in three steps.
Figure 4:
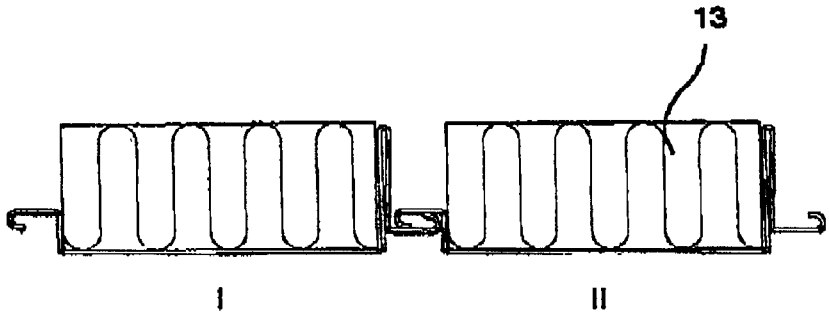
FIG. 4 shows two panels according to the invention to provide insulation.

As is evident from FIG. 3, a panel II can easily be removed from adjacent panels by the left-hand section of panel III being lifted at A and by panel II thereafter being taken away, as illustrated by B and C in the figure, and, as such, it should be realized that by performing these movements in reverse order, without the use of any tools, the panel can easily be replaced in its mounted position.

FIG. 3 shows examples of how each panel can be provided with insulating or sound-absorbing material 13 without the function of the simple mounting or removal being affected. The insulating material 13 can also extend continuously over surface 5 and thereby even cover the joining sections 2 and 3.

It should be realized that even other embodiments than that shown and described are possible within the scope of the concept of the invention stated in the following claims. Accordingly, it can be considered that the principle surface can be profiled in a number of different ways and possibly also have one or more angled stiffening sections positioned in different locations. The hook-shaped sections of the joining sections can be oriented in opposite directions and the elevations in relation to the principle surface be changed in an equivalent way. The flat surface of the lower joining section can, for example, lie on the same level as the principle surface 1.

What is claimed is:

1. A panel, comprising:

an elongated element having a first and second longitudinal edge;

a first joining section disposed along the first longitudinal edge of the elongated element, the first joining section including a first hook disposed at a distance from the first longitudinal edge of the elongated element;

a second joining section disposed along the second longitudinal edge of the elongated element, the second joining section including a second hook disposed at a distance from the second longitudinal edge of the elongated element, the second hook being configured to engage a first hook of an adjacent panel;

wherein the second hook, in a normal mounting position, is arranged at a distance from the first hook of the adjacent panel, and wherein the second hook and the first hook of the adjacent panel engage and interlock if the panels move away from each other.

* * * * *